United States Patent [19]

Sakurai

[11] Patent Number: 4,539,163

[45] Date of Patent: Sep. 3, 1985

[54] CARBURETOR

[75] Inventor: Yoshihiro Sakurai, Iwata, Japan

[73] Assignee: Sanshin Kogyo Kabushiki Kaisha, Japan

[21] Appl. No.: 507,509

[22] Filed: Jun. 24, 1983

[30] Foreign Application Priority Data

Jul. 13, 1982 [JP] Japan ..... 57-120536
Jul. 13, 1982 [JP] Japan ..... 57-120537
Jul. 23, 1982 [JP] Japan ..... 57-127692

[51] Int. Cl.[3] ..... F02M 7/08

[52] U.S. Cl. ..... 261/34 A; 261/51; 261/41 D

[58] Field of Search ..... 261/DIG. 68, 34 A, 51, 261/41 D

[56] References Cited

U.S. PATENT DOCUMENTS 1,917,562 7/1933 Becker et al. ..... 261/34 A
2,235,797 3/1941 Carlson ..... 261/34 A
2,472,692 6/1949 Brown ..... 261/34 A
2,621,029 12/1952 Moseley ..... 261/34 A
2,964,303 12/1960 Smith et al. ..... 261/51
3,003,754 10/1961 Phillips ..... 261/DIG. 68
3,167,599 1/1965 Brown et al. ..... 261/DIG. 68
3,738,622 6/1973 Tuckey ..... 261/DIG. 68

FOREIGN PATENT DOCUMENTS 54-140028 10/1979 Japan ..... 261/34 A

*Primary Examiner*—Tim Miles
*Attorney, Agent, or Firm*—Ernest A. Beutler

[57] ABSTRACT

Several embodiments of charge forming devices embodying enrichment circuits that provide enrichment substantially only when the engine is running above its idle speed and below a predetermined slow speed so as to improve running without excessive fuel consumption under high speed conditions. In each embodiment, the enrichment circuit includes a port in the induction passage upstream of the idle position of the throttle valve and which is served by a fuel well. In accordance with one embodiment of the invention, the discharge of the enrichment circuit is controlled by a throttle valve position responsive valve. In this embodiment, the throttle valve position responsive valve may comprise the pumping element of the accelerating pump. In other embodiments of the invention, the discharge of the enrichment circuit is controlled by providing restricted communication between the fuel source and the enrichment fuel well.

5 Claims, 10 Drawing Figures

Fig-6
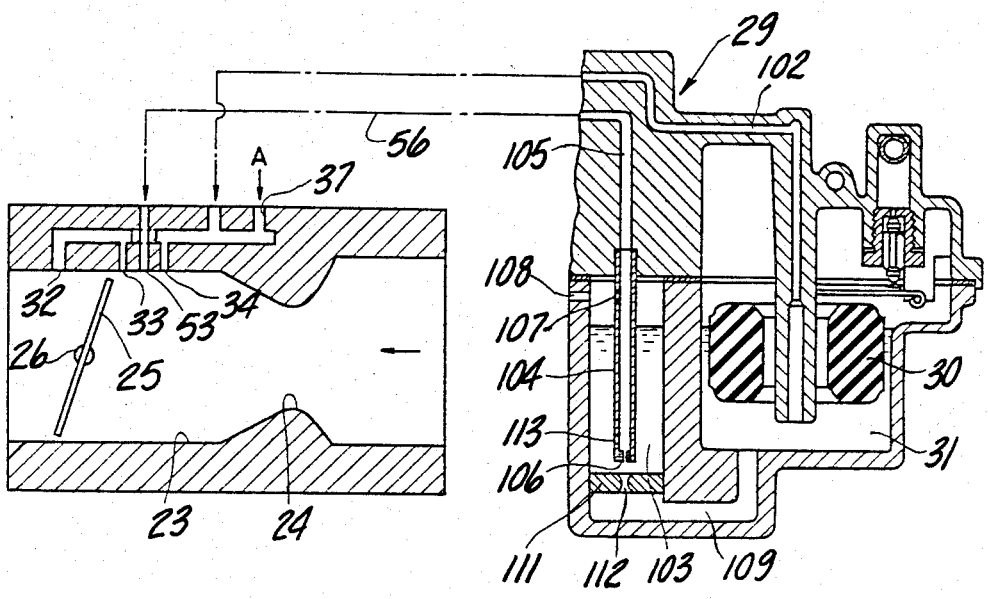
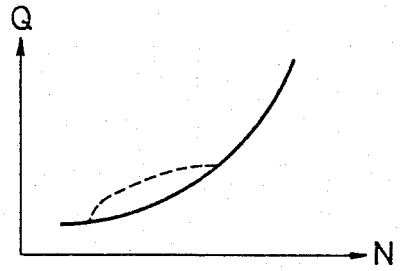
Fig-7

Fig-9
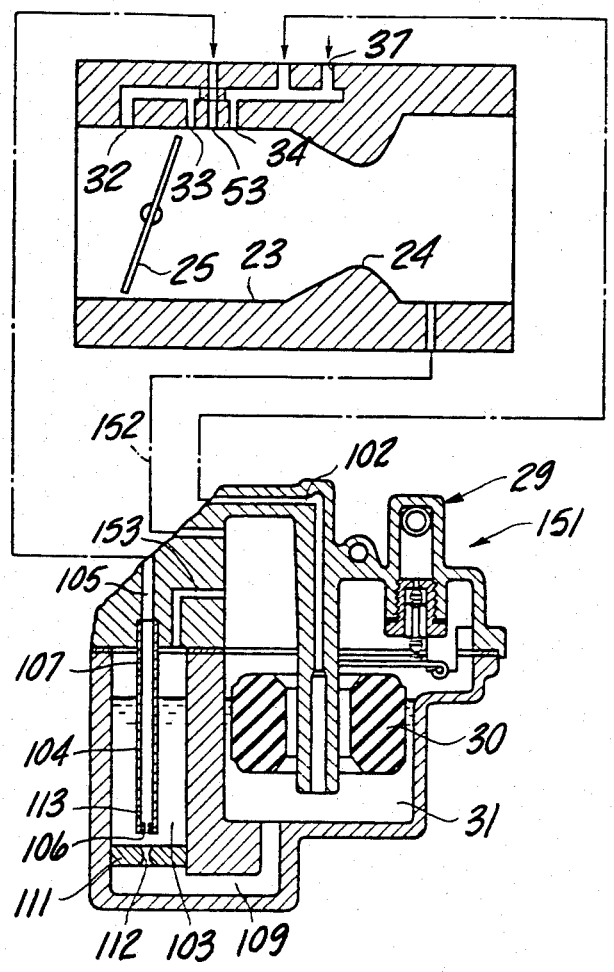
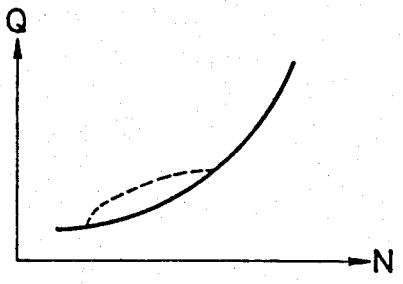
Fig-10

CARBURETOR

BACKGROUND OF THE INVENTION

This invention relates to a carburetor and more particularly to an improved slow and idle fuel supply system for charging forming devices.

As is well known, the carburetor associated with internal combustion engines includes an idle circuit for supplying fuel to the induction system when the throttle valve is in its idle position. Such idle discharges normally include an idle port that opens into the intake passage on the downstream side of the throttle valve when the throttle valve is in its idle position. In addition, it is common to provide the carburetor with transition ports that are disposed in proximity to the idle position of the throttle valve but on the upstream side of it. These transition ports provide air for the idle circuit when the idle port is discharging and also discharge a fuel/air mixture when the throttle valve is opened slightly beyond its idle position. In order to provide good running at idle and low speeds, it is desirable that the idle and transition ports discharge a relatively rich fuel mixture. However, when the engine is operating beyond its low speed conditions, this additional fuel discharge from the idle and transition ports can result in poor fuel economy and also in high degrees of exhaust gas emissions.

It is, therefore, an object of this invention to provide an improved idle and low speed fuel discharge circuit for a carburetor.

It is a further object of this invention to provide a charge forming device for internal combustion engines that provides good running at idle and off idle while at the same time insuring good economy when operating in the higher speed and load ranges.

It is yet a further object of this invention to provide an enrichment device for a change forming device that provides enrichment at low and idle speeds and yet provides no enrichment when running at higher loads.

SUMMARY OF THE INVENTION

A first feature of this invention is adapted to be embodied in a charge forming device for an internal combustion engine or the like which charge forming device has a fuel source, an induction passage, a throttle valve for controlling the flow through the induction passage and an idle circuit communicating the fuel source with a position in the induction passage contiguous to the throttle valve. In accordance with this feature of the invention, enrichment means are provided for delivering fuel from the fuel source to the induction passage substantially only when the associated engine is operating in a speed range between off idle and a predetermined slow speed.

Another feature of this invention is adapted to be embodied in a charge forming device for internal combustion engines or the like having a fuel source, an induction passage and a throttle valve for controlling the flow through the induction passage. In accordance with this feature of the invention, enrichment means are provided for delivering fuel from the fuel source to the induction passage substantially only when the associated engine is operating in an off idle to predetermined slow speed range.

A still further feature of the invention is also to be adapted to be embodied in a charge forming device for an internal combustion engine or the like. Such a charge forming device has a fuel source, an induction passage, a throttle valve for controlling the flow through the induction passage and a fuel discharge circuit including a fuel well communicating the fuel source with the induction passage. In accordance with this feature of the invention, a throttle responsive valve means is provided for controlling the flow of fuel from the fuel source to the well.

BRIEF DESCRIPTION OF THE DRAWINGS

FIG. 6 is a partially cross-sectional, partially schematic view of the carburetor of the embodiment of FIG. 5.

FIG. 7 is a graph showing the fuel discharge rate of the carburetor constructed in accordance with the embodiment of FIGS. 5 and 6.

FIG. 9 is a partial cross-section, partial schematic view, in part similar to FIGS. 2 and 6, showing the embodiment of FIG. 8.

FIG. 10 is a graph showing the fuel discharge characteristics of the embodiment of FIGS. 8 and 9.

DETAILED DESCRIPTION OF THE PREFERRED EMBODIMENTS

Figure 1:
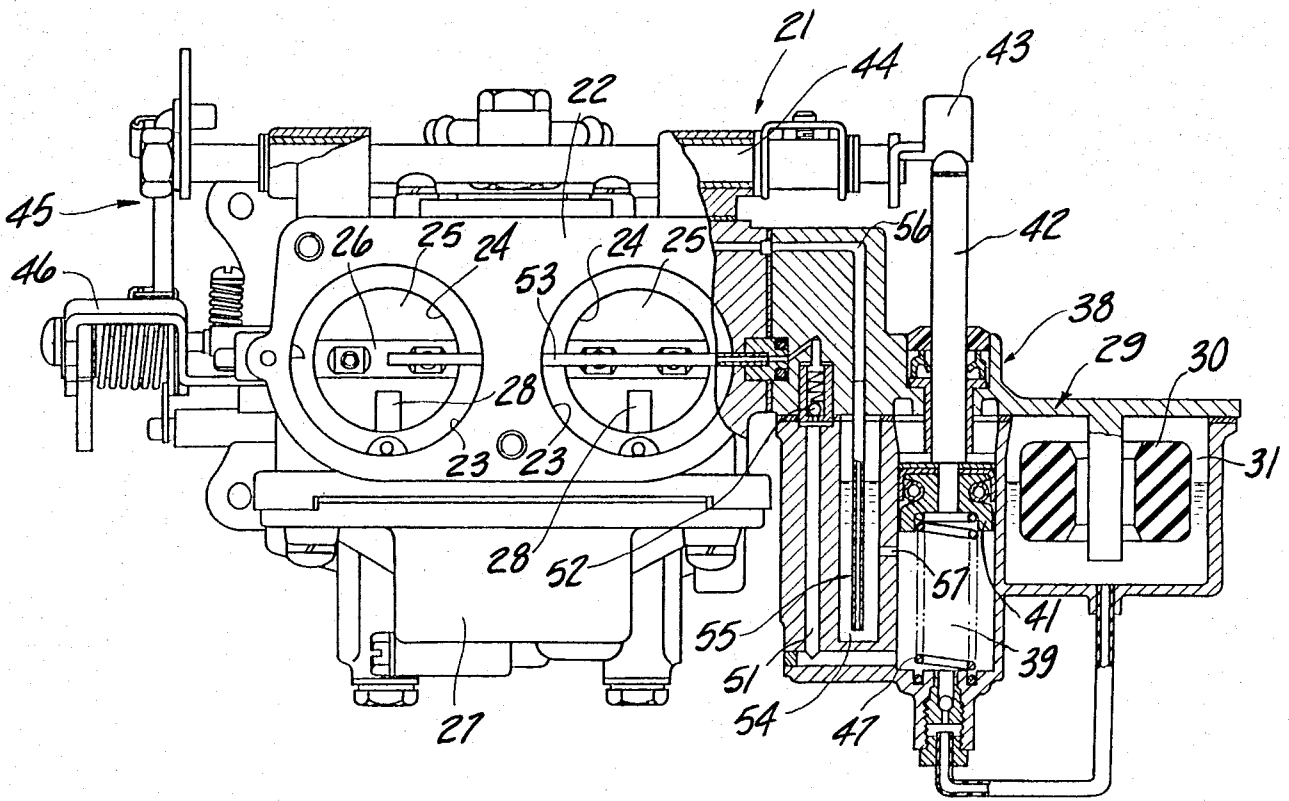
FIG. 1 is an end elevational view of a carburetor constructed in accordance with a first embodiment of the invention, with portions broken away.
Figure 2:
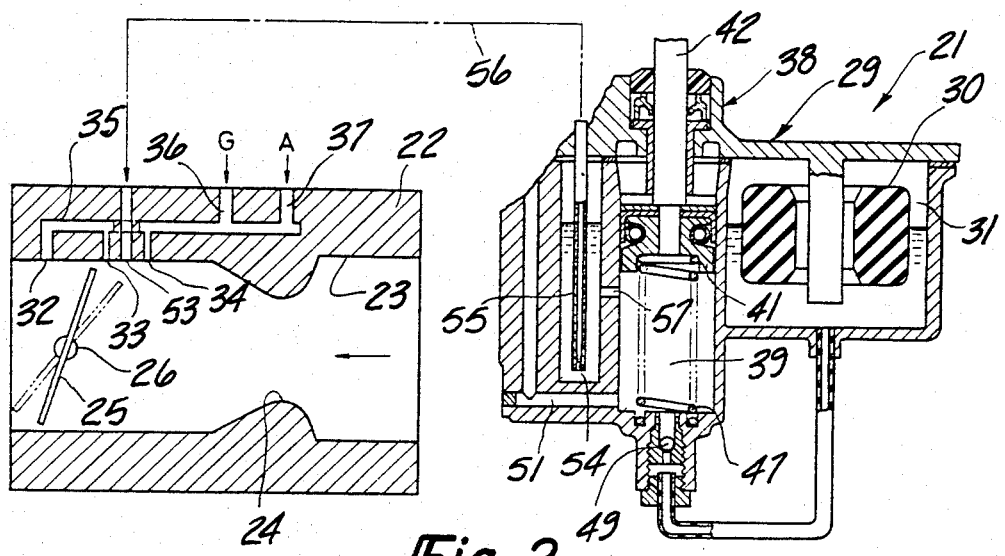
FIG. 2 is a partially cross-section, partially schematic view showing certain of the fuel circuits of the carburetor of FIG. 1.

Referring first to the embodiment of FIGS. 1 through 4, a carburetor constructed in accordance with this embodiment is identified generally by the reference numeral 21. The carburetor 21 is depicted as being of the two barrel, horizontally disposed type and is particularly adapted for use in conjunction with outboard motors. It is to be understood, however, that the invention may be used in conjunction with other types of carburetors or charge forming devices and is applicable for use with other types of internal combustion engines. The carburetor 21 is also adapted to operate using a dual fuel source, although, the invention can be used in conjunction with single fuel carburetors.

The carburetor 21 includes a main body portion 22 having a pair of horizontally disposed side-by-side induction passages 23. Each induction passage 23 is formed with an integral venturi section 24. Throttle valves 25 are positioned in each of the induction passages 23 downstream of the venturi sections 23. The throttle valves 25 are each affixed to a common throttle valve shaft 26 that is rotatably supported in the carburetor body 22 in a known manner.

A fuel bowl 27 is affixed to the underside of the carburetor body 22 and contains a fuel reservoir to which the main running fuel, which may be of a character such as kerosene, is delivered and maintained at a desired level. A main fuel discharge including main fuel discharge nozzles 28 extend from the fuel bowl 27 to the induction passages 23 in proximity to the venturi sections 24 so as to provide the main running fuel. The main fuel discharge circuits form no portion of this invention and, therefore, have not been illustrated nor will they be described.

An auxiliary body, indicated generally by the reference numeral 29, is affixed to one side of the main body 22. The auxiliary body 29 is formed with a float chamber or fuel bowl 31 to which an auxiliary fuel such as gasoline is delivered. In accordance with the dual fuel embodiment of the invention, the auxiliary fuel from the fuel bowl 31 provides fuel for idle and off idle conditions and also fuel for the accelerating pump circuit, as will be described.

A float 30 is provided in the fuel bowl 31 and is cooperative with an associated needle valve (not shown) for maintaining a uniform level of auxiliary fuel in the fuel bowl 31.

An idle discharge port 32 (FIG. 2) is provided in each of the carburetor barrels 23 at a position downstream of the idle position of the throttle valve 25, which idle position is shown in the solid line view in this figure. In addition, a pair of transition ports 33 and 34 also extend into the induction passage 23 at positions spaced above the idle position of the throttle valve 25. As the throttle valve 25 is rotated in an opening direction, the transition ports 33 and 34 will be sequentially opened. The ports 32, 33 and 34 are all fed by means of a common passageway 35 to which fuel is delivered through a fuel inlet 36 from the auxiliary fuel bowl 31 through an appropriate metering circuit. In addition, metered air is added to this passage 35 from an air bleed 37 as is well known in this art. During idle, when the throttle valve 25 is in its idle position, fuel and air will be discharged from the idle port 32. The fuel is delivered through the passage 36 and air is drawn both through the passage 37 and through the transition ports 33 and 34. As the throttle valve 25 is progressively opened and the port 33 is uncovered, fuel will begin to be discharged through this passage in addition to the idle port 32. As further opening is encountered, fuel will also be delivered through the transition port 34.

An accelerating pump assembly, indicated generally by the reference numeral 38, is provided for injecting additional fuel from the auxiliary fuel bowl 31 into the induction passages 23 during sudden opening of the throttle valves 25. The accelerating pump assembly 38 includes a pump chamber 39 that is formed in the auxiliary body 29 adjacent to the fuel bowl 31. An accelerating pump piston 41 is supported for reciprocation in the pump chamber 39 and is connected to a piston rod 42 that extends upwardly through the upper portion of the auxiliary body 29. A lever 43 is affixed to a pump actuating shaft 44 that is journaled in a bearing assembly on the main carburetor body portion 22. The accelerating pump actuating shaft 44 is rotated by means of a linkage mechanism 45 in response to rotation of an actuating lever 46 that is coupled to the throttle valve shaft 26 so that when the throttle valves 25 are opened, the piston rod 42 and piston 41 will be urged downwardly. A coil compression spring 47 received in the pump chamber 39 acts on the piston 41 so as to return it and the piston rod 42 upwardly when the throttle valves 25 are closed.

Fuel may be drawn into the pump cavity 39 during upward movement of the piston 41 from the fuel bowl 31 through a passage 48 and past a delivery check valve 49. When the piston 41 is moved downwardly, the fuel in the pump cavity 39 will be discharged through an accelerating pump discharge passage 51 formed in the auxiliary body 29, through a discharge check valve 52 and to an accelerating pump discharge nozzle 53 (FIG. 1). The nozzle 53 extends through one of the induction passages 23 and terminates at the center of the other induction passage upstream of the venturi section 24. Downwardly directed discharge openings (not shown) are provided in the accelerating pump discharge nozzle 53 so that the fuel driven from it will be discharged in the direction of air flow through the induction passages 23.

In accordance with the invention, an arrangement is provided for providing auxiliary enrichment by means of the auxiliary fuel only during a certain predetermined portion of the off idle operation. This system includes an enrichment discharge port 53 (FIG. 2) that is positioned in the induction passage 23 upstream of the idle position of the throttle valves 25. The enrichment discharge port 53 is positioned axially in the induction passage 23 at a location corresponding to the opening of the throttle valve 25 at which the enrichment is desired. Thus, the lower the speed at which the discharge of the enrichment from the port 53 is desired, the closer the port 53 will be positioned to idle position of the throttle valves 25.

Fuel is delivered to the enrichment port 53 from an auxiliary enrichment fuel well 54 positioned in the auxiliary body 29 by means of an enrichment tube 55 and passageway, indicated schematically at 56. A suitable jet may be positioned at the lower end of the tube 55 so as to control the amount of fuel delivered from the well 54. In accordance with this embodiment of the invention, fuel is supplied to the enrichment well 54 from the pump chamber 39 a passageway 57 that is located so that the passageway 57 will be opened when the accelerating pump piston 41 is in its idle position and so as to be closed when the throttle 25 is opened to a predetermined extent.

Figure 4:
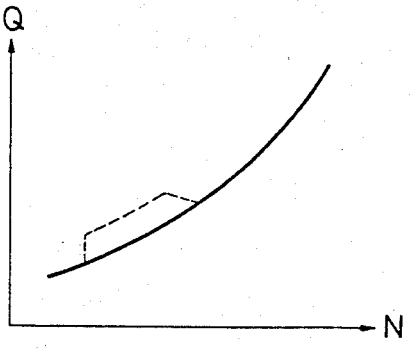
FIG. 4 is a curve showing the fuel discharge of the carburetor constructed in accordance with this embodiment.

FIG. 4 shows the amount of fuel discharged by the various fuel delivery systems of the carburetor 21. In this figure, the engine speed and, accordingly, throttle opening, is shown on the abscissa as dimension N whereas the amount of fuel discharged is shown on the ordinate as the dimension Q. During idle when the throttle valves 25 are in their idle position, idle fuel will be delivered through the idle ports 32. Air will be added to the idle fuel from the transition ports 33 and 34 and through the air bleed 37. The fuel for idling is delivered, as has been aforenoted, from the auxiliary fuel bowl through the passage 36.

As the throttle valves 25 are rotated toward their open position, the transition port 33 will eventually become uncovered and fuel will additionally be discharged through this port. The fuel discharge follows a gradually increasing curve as shown in FIG. 4.

When the throttle valve 25 is opened to such a point that the auxiliary enrichment port 53 is opened, this port will additionally flow fuel into the induction passage 23 to provide a further enrichment as shown in the dotted line portion of FIG. 4. This additional fuel is drawn from the well 54 through the tube 55 and passage 56. As this fuel is withdrawn, the level will be depleted in the well, however this will be replenished as long as the throttle valves 25 are not opened sufficient so that the accelerating pump piston 41 covers the communication port 57.

Figure 3:
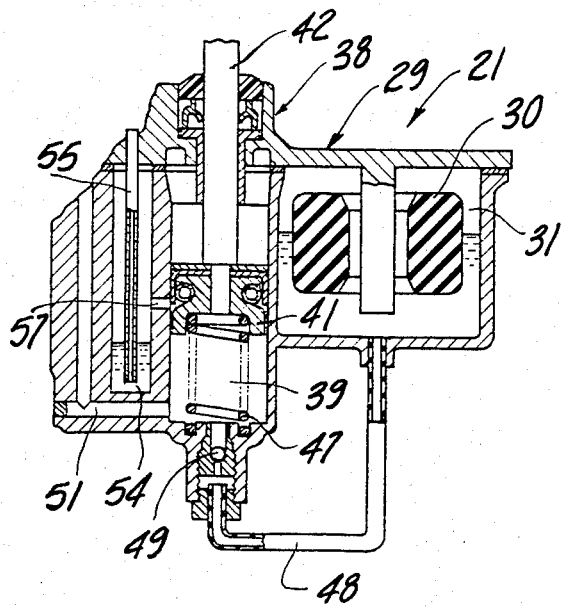
FIG. 3 is a cross-sectional view, in part similar to FIGS. 1 and 2, showing the construction when operating above a predetermined speed.

When the throttle valves 25 are opened sufficiently that the piston 41 is positioned to close the communication port 57, fuel will be continued to be drawn from the well 54 until it is depleted in level as shown in FIG. 3. At this point, the enrichment will be discontinued and the wastage of auxiliary fuel during such running conditions will be precluded.

As with conventional carburetors, once the throttle valves 25 are more fully opened, the main fuel discharge from the nozzles 28 will occur and the additional enrichment of the auxiliary fuel is unnecessary. Because the source of fuel to the well 54 is cut off by the position of the accelerating pump piston 41, wastage of fuel will be avoided.

Figure 5:
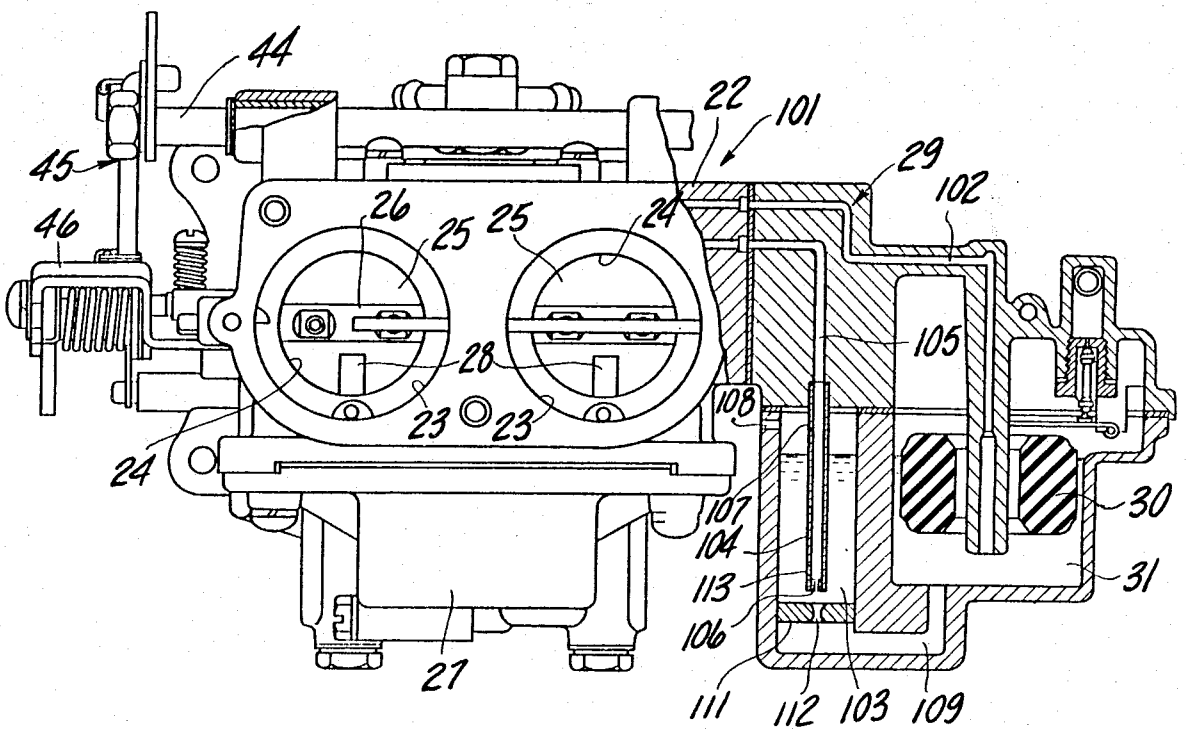
FIG. 5 is an end elevational view, with portions broken away, of a carburetor constructed in accordance with another embodiment of this invention.

In the embodiment of FIGS. 1 through 4, the discharge of fuel from the auxiliary enrichment port is controlled by means of a valve that is responsive to throttle position. In the illustrated embodiment, this valve comprises the piston of the accelerating pump. It is to be understood, of course, that other throttle operated valves may be used for controlling the discharge of the auxiliary enrichment system. In addition, rather than using a valve for controlling the auxiliary fuel discharge, it may be possible to control this discharge and prevent the discharge of auxiliary fuel during high speed running in other ways. FIGS. 5 through 7 show such an embodiment.

In this embodiment, the construction of the carburetor per se and its idle and transition discharge circuits is the same as the previously described embodiment. For this reason, components which are the same as in the previously described embodiment have been identified by the same reference numerals. These common elements will not be described again, except insofar as is necessary to understand the operation of this embodiment.

Turning now specifically to the embodiment of FIGS. 5 and 6, a carburetor constructed in accordance with this embodiment is identified generally by the reference numeral 101. As has been noted, the idle and transition fuel discharge circuits of the carburetor 101 are the same as the carburetor 21 of the embodiments of FIGS. 1 through 3. Therefore, these portions of the carburetor will not be described again. However, in this embodiment, the idle and transition fuel is supplied from the auxiliary fuel bowl 31 by means of a passage and metering arrangement, indicated at 102. A similar passage may be used in conjunction with the embodiments of FIGS. 1 through 4 although it has not been shown in that embodiment.

With this embodiment, the auxiliary enrichment port 53 is served by a passage, shown schematically at 56, which communicates with an auxiliary fuel enrichment well 103 formed in the auxiliary body portion 29. A metering tube 104 extends from a passage 105 formed in the body 29 that communicates with the passage way 56. The tube 104 carries a metering jet 106 at its lower end for controlling the rate of fuel flow through the tube 104 to the enrichment port 53. An air bleed opening 107 is positioned in the side wall of the tube 104 at a level above the normal level of fuel in the well 103 so as to mix air with the fuel discharge through the enrichment port 53. Air is admitted to the area above the fuel in the well 103 through an atmospheric air port 108 formed in the auxiliary body 29.

In this embodiment, the auxiliary enrichment well 103 communicates directed witth the auxiliary fuel bowl 31 through a passage 109. Rather than controlling the discharge of the auxiliary enrichment port 53 by means of a throttle operated valve, the discharge is controlled by means of a plate 111 having a restricted orifice 112 positioned at the bottom of the well 103 and controlling the communication of the passage 109 with the well 103 in the manner now to be described.

This embodiment operates in a manner similar to the embodiment of FIGS. 1 through 4. The fuel discharge of this embodiment in relation to engine speed is as shown in the curve of FIG. 7.

During idle, the throttle valves 25 will be substantially fully closed and idle fuel will be discharged through the idle port 32. Air will be drawn in for the idle discharge through the transition ports 33 and 34 and no fuel will be discharged through the auxiliary enrichment port 53 since this port is exposed to substantially atmospheric pressure.

As the throttle valves 25 are progressively opened, the fuel discharge will increase as shown in FIG. 7. Eventually the transition port 33 will be opened and it will also discharge fuel into the induction passage 23.

When the throttle valves 25 are opened sufficiently so as to uncover the auxiliary enrichment ports 53, fuel will be drawn from the auxiliary enrichment well 103 for discharge through the port 53. As has been previously noted, air will be mixed with this fuel through the air bleed port 107 of the tube 104. The enrichment provided by the auxiliary enrichment system is shown in the broken line portion of FIG. 7.

When the auxiliary enrichment port 53 commences to discharge fuel, the fuel in the well 103 will be depleted. Fuel will be replenished at a restricted rate due to the orifice 112 and, therefore, as the throttle valve 25 is opened and the engine speed increases, the level of fuel in the well 103 will diminish.

At a predetermined engine speed as determined by the size of the orifice 112 in relation to the size of the metering jet 106, an air bleed port 113 positioned at the bottom of the tube 104 will eventually become uncovered and bleed additional air into the enrichment discharge circuit. This additional air bleed insures a good transition back to normal running conditions when the auxiliary enrichment circuit no longer ceases to operate due to depletion of fuel in the well 103. The fuel discharge curve then returns to the conventional curve and further enrichment from the auxiliary enrichment port 53 ceases to occur. Thus, as with the previously described embodiment, enrichment is provided only during a predetermined engine speed which exists between off idle and up to part load.

Figure 8:
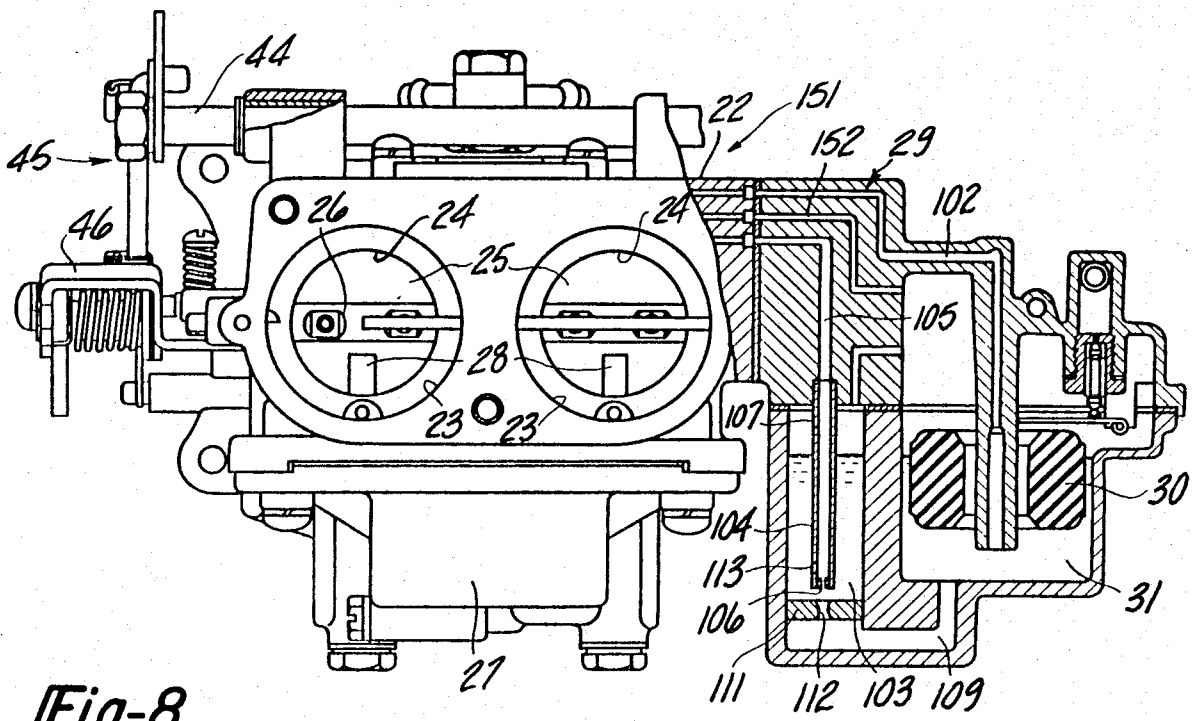
FIG. 8 is an end elevational view, with portions broken away, in part similar to FIGS. 1 and 5 and shows a further embodiment of the invention.

A carburetor constructed in accordance with a still further embodiment of this invention is illustrated in FIGS. 8 through 10 and is identified generally by the reference numeral 151. The carburetor 151 is substantially the same as the embodiment of FIGS. 5 through 7 and, for that reason, components which are the same have been identified by the same reference numerals and will be described again only insofar as is necessary to understand the operation of this embodiment. This embodiment employs an arrangement for further insuring against the discharge of fuel from the auxiliary enrichment system once the engine speed is above a predetermined speed.

In accordance with this embodiment, the area above the fuel in the auxiliary fuel bowl 31 is vented to a position in the induction passage 23 upstream of the venturi section 24 by means of a fuel bowl venting passage 152. In turn, the area above the fuel in the enrichment fuel well 103 is vented to the area above the fuel in the main fuel bowl 31 by means of a passage 153 formed in the auxiliary body portion 29. It will be remembered that the area above the fuel in the auxiliary enrichment well 103 in the embodiment of FIGS. 5 through 7 was vented directly to the atmosphere.

In accordance with this embodiment, the idle, off idle and initial auxiliary enrichment discharge are the same as the embodiment of FIGS. 5 through 7 and the discharge curve is as shown in FIG. 10. In accordance with this embodiment, when the throttle valves 25 are opened sufficiently that the main fuel discharge begins to operate, the pressure at the venting port for the fuel bowl vent 152 will become slightly less than atmospheric. This reduced pressure is exerted above the fuel in the well 103 so as to cause a more abrupt decrease in the discharge of the fuel from the auxiliary enrichment circuit so as to insure against continued discharge once the main fuel discharge begins to operate. In all other regards, this embodiment operates as the previously described embodiments.

It should be readily apparent from the foregoing description that each embodiment provides an auxiliary enrichment system that provides additional enrichment fuel for off idle conditions until the engine speed reaches a predetermined speed. Additional discharge of this enrichment fuel is precluded, however, once the speed of the engine exceeds a predetermined value. Although the arrangement has been illustrated and described in conjunction with carburetors having generally conventional idle and transition discharge ports, it should be understood that the invention can be used in conjunction with a carburetor having only an idle discharge port with the auxiliary enrichment port serving the function of the transition ports of conventional carburetors. Also, as has been previously noted, although the invention has been described in conjunction with dual fuel carburetors, it can be used with carburetors of the single fuel type. In such arrangements, the auxiliary enrichment well will communicate with the main fuel bowl rather than an auxiliary fuel bowl as described in conjunction with the multi-fuel embodiments. Various other changes and modifications may be made without departing from the spirit and scope of the invention, as defined by the appended claims.

I claim:

1. In a charge forming device for an internal combustion engine or the like having a fuel source, an induction passage, a throttle valve for controlling the flow through said induction passage, and an idle circuit communicating said fuel source with a position in said induction passage contiguous to said throttle valve, a main fuel discharge circuit for discharging fuel from said fuel source into said induction passage upstream of said idle circuit and said throttle valve, an accelerating pump comprising an accelerating pump well in communication with said fuel source, a pumping element operably connected to said throttle valve and movable in said accelerating pump well in response to movement of said throttle valve for pressurizing fuel contained therein and an accelerating pump discharge for discharging pressurized fuel into said induction passage, the improvement comprising enrichment means for delivering fuel from said fuel source to said induction passage substantially only when the associated engine is operating in an off idle to a predetermined slow speed range, said enrichment means comprising an enrichment well, an enrichment discharge circuit for delivering fuel from said enrichment well to said induction passage, and passage means communicating said enrichment well with said accelerating pump well for supplying fuel to said enrichment well from said accelerating pump well, said passage means communicating with said accelerating pump well at a position wherein said passage means will be closed by said pumping element when said throttle valve is opened to a point where the associated engine is operating above the predetermined slow speed range.

2. In a charge forming device as set forth in claim 1 wherein the enrichment means communicates with the induction passage independently of the idle circuit.

3. In a charge forming device as set forth in claim 2 wherein the idle circuit includes an idle port positioned downstream of the idle position of the throttle valve and at least one transition port positioned upstream of the idle position of the throttle valve.

4. In a charge forming device as set forth in claim 2 wherein the discharge of the enrichment means is positioned at a location spaced along the induction passage from the discharge of the idle circuit.

5. In a charge forming device as set forth in claim 4 wherein the idle circuit has a discharge port positioned on the downstream side of the idle position of the throttle valve and the enrichment means has a discharge port positioned on the upstream side of the idle position of the throttle valve.

* * * * *